United States Patent [19]

Futch et al.

[11] Patent Number: 4,989,908

[45] Date of Patent: Feb. 5, 1991

[54] LATCHING DEVICE FOR SLIDING DOOR/WINDOW

[76] Inventors: Clark R. Futch, 1406 S. Dogwood; Bobbie W. Futch, 1410 Cecil Rd., both of Nashville, Ga. 31639

[21] Appl. No.: 566,138

[22] Filed: Aug. 13, 1990

[51] Int. Cl.[5] ..... E05C 1/16

[52] U.S. Cl. ..... 292/341.15; 70/97; 292/DIG. 46

[58] Field of Search ..... 292/341.15, 341.14, 292/DIG. 46, 161, 158; 70/97

[56] References Cited

U.S. PATENT DOCUMENTS

| | | | |
|---|---|---|---|
| 2,175,485 | 10/1939 | Roberts | 292/158 |
| 2,904,367 | 9/1989 | Bennett et al. | 292/341.15 |
| 2,990,208 | 6/1961 | Miller | 70/97 |
| 3,026,702 | 3/1962 | Cary | 70/97 |
| 3,213,652 | 10/1965 | Tucker | 70/97 |
| 3,956,911 | 5/1976 | Corboud | 292/DIG. 46 |
| 4,109,749 | 8/1978 | Smith | 70/97 |
| 4,500,122 | 2/1985 | Douglas | 292/341.15 |

*Primary Examiner*—Eric K. Nicholson
*Attorney, Agent, or Firm*—Harry I. Leon

[57] ABSTRACT

A latching device for sliding doors/windows which has a smooth, modern appearance and which enables a person to free himself. The device is used in combination with a push-bolt or bayonet style door lock mounted on a sliding door/window. Means for latching the bolt of the lock to the frame of the door/window includes a slotted, slideable frame member. The slideable frame member fits unobtrusively against the frame with no protruding parts. The bolt on the lock can be extended into a notch which is formed in the frame of the door/window and which includes a side opening. When the door/window is locked, the slideable frame member blocks this side opening, so that the bolt cannot escape. Alternately, by bringing a cutout in the frame member into alignment with the side opening, the frame member can be positioned so as not to block the side opening, thereby forming an opening through the bolt can move sideways. To so position the frame member, it is slid transversely to the direction of the tracks for the door/window until the frame member abuts a stop on the frame itself. Thus the slideable frame member allows the door/window to be opened from the inside even when the bolt is in its extended position.

5 Claims, 2 Drawing Sheets

LATCHING DEVICE FOR SLIDING DOOR/WINDOW

BACKGROUND OF THE INVENTION

This invention relates to locks for sliding doors and windows.

Cylindrical locks having a bolt which, when locked, extends perpendicularly to the main surface of the door/window on which the lock is mounted are known in the prior art. Among such locks are Models 2000M and 2460M manufactured by Sugatune America, Inc. and others designed for use with sliding doors/windows. Locking each of them entails inserting a bolt into a hole in the frame. Such a locking technique is well suited for show cases but may present a problem if used on a door or window which serves as an ingress/egress to a room, cabin or closet since the door or window so locked cannot be opened from the inside.

SUMMARY OF THE INVENTION

In accordance with the present invention, there is provided a latching device for push-bolt door locks used for locking sliding doors/windows. The latching device comprises a stationary member that is rigidly attached to the frame of the door/window and a frame member that is slideably mounted on the stationary member. The stationary member, which can be made from an standard angle section, has two faces joined to an disposed perpendicularly to each other. A notch formed at the juncture between these two faces extends a substantial distance across both of them. On one face, the notch is rounded, with a sufficient radius of curvature to receive the bolt. On the other face, the notch forms a side opening for the bolt and is sufficiently wide and long to allow the bolt, even when it is fully extended, to escape sideways.

The slideable frame member includes a cutout similar in outline and size to the side opening of the notch. This cutout can be aligned with this side opening. In most applications, the latching device is so mounted that when the slideable frame member is in a fully lowered position, solid structure in this member blocks the side opening. But when the slideable frame member is raised to the full extent of its travel, the cutout in the frame member is brought into alignment with the side opening, so that the door/window can be opened even when the bolt is extended.

In order to facilitate unlatching the lock, a finger hole is provided in the slideable frame member, so that it can easily be raised or lowered relative to the stationary member. Furthermore, the use of a finger hole for such operations. eliminates the need for protruding arms and the like, giving the slideable frame member a generally smooth overall surface which cannot obstruct a person's passage through, or catch his clothing as he passes through, the opening of the sliding door/window. Moreover, the absence of any protruding arm or the like makes the slideable frame member nearly unnoticeable.

A further object of the present invention is to provide a latching device suitable for use on door/windows of department stores, homes and boats.

BRIEF DESCRIPTION OF THE DRAWINGS

FIG. 2 is an elevation view of a side of the latching device according to FIG. 1 which, in use, faces the door, the latching device being shown in the closed position;

FIG. 3 is an elevation view of a side of the latching device according to FIG. 1 which, in use, is mounted perpendicular to the door, the latching device being shown in the closed position and the lock bolt being shown in dashed lines; and FIG. 4 is an end view of the latching device according to FIG. 1, the lock bolt being shown in dashed lines.

DESCRIPTION OF THE PREFERRED EMBODIMENT

Figure 1:
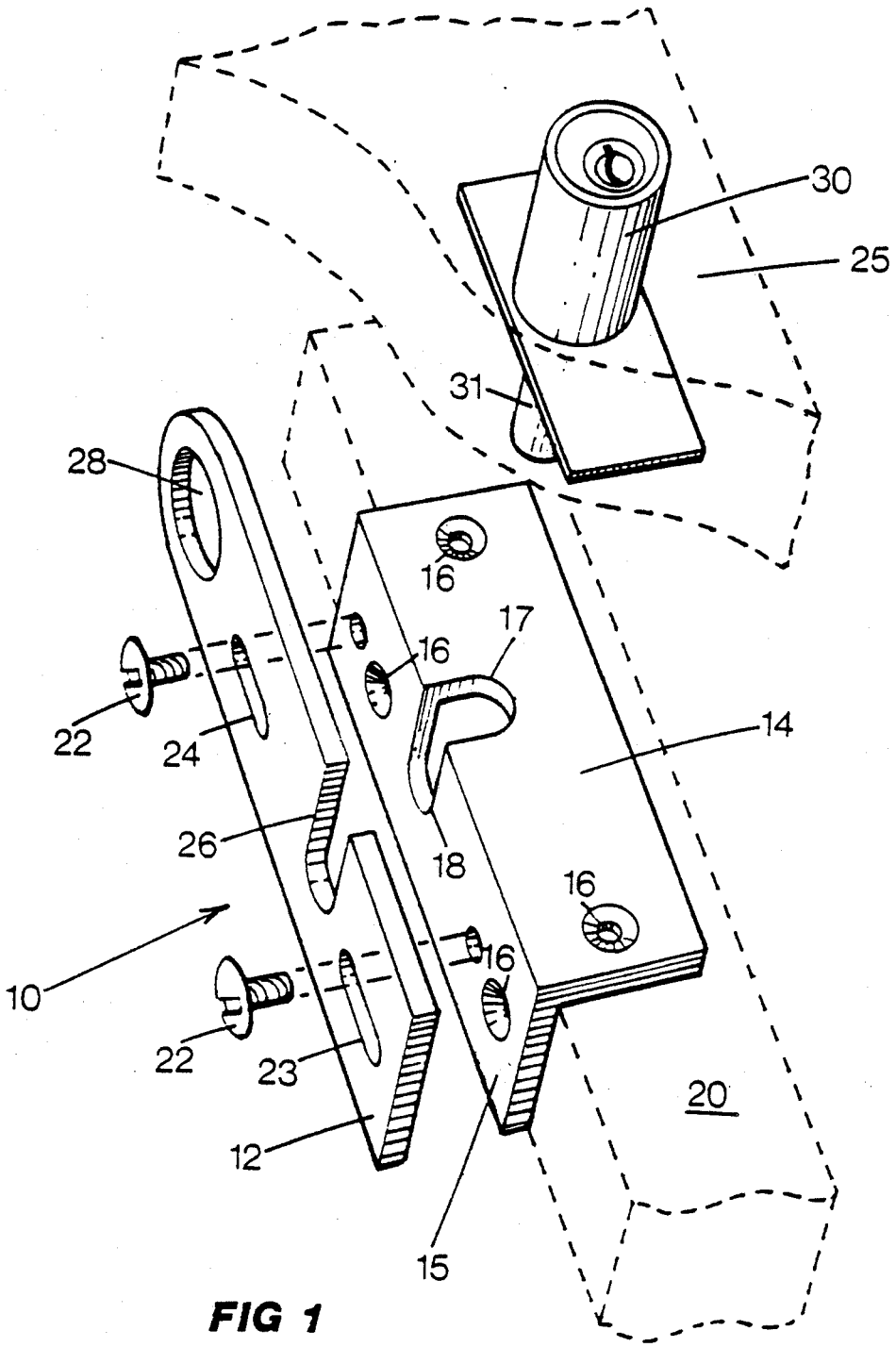
FIG. 1 is an exploded perspective view showing the latching device for sliding doors/windows according to the present invention.

In the drawings, a device for locking and unlatching sliding doors/windows 25 is indicated generally by the reference numeral 10. This device 10 is particularly suited for use with push-bolt sliding door locks 30. The locks 30 are well known and are actuated when a bolt 31 is extended as the result either of the pushing of a locking cylinder or of its being turned with a key.

The device 10 comprises two major parts, a stationary member indicated generally by the reference numeral 11 and a slideable frame member indicated generally by the reference numeral 12. The stationary member 11 includes an elongated angular section having perpendicularly disposed faces 14, 15, which is fixed to the frame 20 of a door or window by fasteners such as screws (not shown) inserted into holes 16 formed in the faces 14, 15. The faces 14, 15 are rigidly joined to each other along a corner edge 19. The stationary member 11 may be mounted either flush with or recessed into the frame 20.

A notch 17 is cut into the corner edge 19 and extends from this edge across both of the faces 14, 15. The cross-sections of the notch 17 disposed transversely to the longitudinal axis of the bolt 31 are sized to receive this bolt when it is fully extended. In the face 15, on the other hand, the notch 17 forms a side opening 18 which is slightly longer than the bolt 31. The side opening 18 allows the bolt 31, even when it is fully extended, to be moved into or out of the notch 17 in a direction perpendicular to the face 15. When the slideable frame member 12 is suitably positioned, the bolt 31 can be moved through the side opening 18 simply by sliding the door/window 25 along its tracks (not shown).

The frame member 12 is movably attached to the stationary member 11 by a pair of pins 22. The pins 22 are slideably received by a pair of elongated slots 23, 24 formed in the member 12, which are longitudinally spaced apart from, and disposed parallel to, each other. The pins 22 and slots 23, 24 limit the sliding motion of the frame member 12 relative to the stationary member 11 to a direction perpendicular to the direction in which the door/window 25 can be slid. A cutout 26 formed in the slideable frame member 12 has approximately the same shape and size as does the side opening 18. In the preferred embodiment, the cutout 26 can be aligned with the side opening 18 at the upper limit of travel of the member 12 relative to the member 11. At this upper limit of travel, the pins 22 abut the lower ends of the slots 23, 24. When the member 12 is at its lower limit of travel, on the other hand, the body 27 of the member 12 covers the side opening 18, securing the bolt 31 if it is extended in the notch 17 and thereby locking the door/-window 25.

A finger hole 28 is preferably formed in the upper portion of the slideable frame member 12 to facilitate moving the member 12 upwardly along the slots 23, 24. The use of the finger hole 28 instead of a handle or arm provides a smooth surface around the passageway bounded by the frame 20, eliminating any protrusions on which clothing might snag.

In normal operation, the slideable frame member 12 is in the down position with an uncut portion of its body 27 being disposed adjacent to the side opening 18. With the frame member 12 in this down position, the door/-window 25 can be unlocked, from the outside, only with the use of a key. But from the inside, a person can unlatch the door/window 25 with one finger, just by pushing an upper edge of the finger hole 28 to raise the member 12. Thus an individual, otherwise locked inside the door/window 25, can escape through it without using a key.

It is apparent from the foregoing that a new and improved apparatus for latching sliding doors/windows has been provided. While only the presently preferred embodiment of the invention has been disclosed, as will be apparent to those familiar with the art, certain changes and modifications can be made without departing from the scope of the invention as defined by the following claims.

It is claimed:

1. An improved device for latching a door slideably mounted within a frame wherein a bolt of a push-bolt lock mounted on the door can be extended into a recess formed in the frame, wherein the improvement comprises:

(a) a stationary member fixed to the frame and having two surfaces disposed perpendicularly to each other which form a corner edge, the first of the two surfaces being disposed parallel to the door; the corner edge bounding a passageway created when the door is opened;

(b) the stationary member having a notch formed in the corner edge, the notch extending across both of said surfaces and communicating with the recess, the portion of the notch extending across the first surface being disposed transversely to the longitudinal axis of the bolt and being sized to receive the bolt when it is extended into the recess; the notch including a side opening disposed perpendicularly to said portion, the side opening being sufficiently wide and long to allow the bolt, when fully extended, to be moved sideways through the side opening; and (c) a frame member slideably mounted on the stationary member, the frame member having a cutout that is similar in shape and size to the side opening; and (d) means for aligning the cutout in the frame member with the side opening in the stationary member, thereby enabling the bolt, even when fully extended, to be moved sideways through both the side opening and the cutout.

2. An improved device according to claim 1 wherein the aligning means further comprises the frame member having a finger hole formed therein, the finger hole being accessible from the inside of the door, so that the door can be unlatched from the inside without retracting the bolt.

3. An improved device for latching a window slideably mounted within a frame wherein a bolt of a push-bolt lock mounted on the window can be extended into a recess formed in the frame, wherein the improvement comprises:

(a) a stationary member fixed to the frame and having two surfaces disposed perpendicularly to each other which form a corner edge, the first of the two surfaces being disposed parallel to the door; the corner edge bounding a passageway created when the door is opened;

(b) the stationary member having a notch formed in the corner edge, the notch extending across both of said surfaces and communicating with the recess, the portion of the notch extending across the first surface being disposed transversely to the longitudinal axis of the bolt and being sized to receive the bolt when it is extended into the recess; the notch including a side opening disposed perpendicularly to said portion, the side opening being sufficiently wide and long to allow the bolt, when fully extended, to be moved sideways through the side opening; and (c) a frame member slideably mounted on the stationary member, the frame member having a cutout that is similar in shape and size to the side opening; and (d) means for moving the cutout in the frame member alternately in and out of alignment with the side opening in the stationary member, the cutout moving means being accessible only from the inside of the window when it is closed.

4. The improved device according to claim 3 wherein the cutout moving means is further characterized as not presenting any obstruction in the passageway created when the window is opened.

5. An improved device according to claim 3 wherein the cutout moving means further comprises the frame member having a finger hole formed therein, the finger hole being accessible from the inside of the door, so that the door can be unlatched from the inside without retracting the bolt.

* * * * *